US007294775B1

(12) United States Patent
Spoljaric, Jr.

(10) Patent No.: US 7,294,775 B1
(45) Date of Patent: Nov. 13, 2007

(54) DRUM SUPPORT ASSEMBLY

(76) Inventor: John J. Spoljaric, Jr., 13453 S. 600 West, Hanna, IN (US) 46340

( * ) Notice: Subject to any disclaimer, the term of this patent is extended or adjusted under 35 U.S.C. 154(b) by 194 days.

(21) Appl. No.: 11/261,869

(22) Filed: Oct. 31, 2005

(51) Int. Cl.
*G10D 13/02* (2006.01)

(52) U.S. Cl. ..... 84/421; 84/327; 84/423 R; 224/268; 248/346.01

(58) Field of Classification Search ..... 84/327, 84/421, 423; 224/268; 248/346.01
See application file for complete search history.

(56) References Cited

U.S. PATENT DOCUMENTS

| | | | | |
|---|---|---|---|---|
| 2,559,739 | A | 1/1951 | Sherman | |
| 4,102,237 | A * | 7/1978 | Suess et al. | 84/421 |
| 4,126,075 | A * | 11/1978 | Kurosaki | 84/421 |
| D311,201 | S | 10/1990 | Nakayama et al. | |
| 5,691,492 | A | 11/1997 | May | |
| 5,797,569 | A * | 8/1998 | Simons | 248/187.1 |
| 5,973,249 | A * | 10/1999 | Liao | 84/421 |
| 6,403,869 | B2 | 6/2002 | May | |
| 6,459,027 | B1 * | 10/2002 | Van Dermeulen | 84/421 |
| 6,604,720 | B1 * | 8/2003 | Wilson | 248/177.1 |
| 6,770,805 | B2 * | 8/2004 | May | 84/421 |
| 6,971,624 | B2 * | 12/2005 | Kollar et al. | 248/274.1 |
| 7,128,368 | B2 * | 10/2006 | Sligh | 297/186 |
| 2004/0051021 | A1 * | 3/2004 | Micheel | 248/346.01 |
| 2005/0029208 | A1 * | 2/2005 | Paiste et al. | 211/85.6 |
| 2005/0274854 | A1 * | 12/2005 | May | 248/171 |
| 2006/0049319 | A1 * | 3/2006 | May | 248/166 |

* cited by examiner

*Primary Examiner*—Lincoln Donovan
*Assistant Examiner*—Robert W. Horn

(57) ABSTRACT

A drum support assembly includes an elongated plate that has a bottom end and a top end. The plate has a first side and a second side. A bottom panel is attached to the bottom end. The bottom panel has a top side and a bottom side. An angle between the top side and the first side is generally between 100 degrees and 160 degrees. The bottom panel has a plurality of apertures extending therethrough. Each of a plurality of fasteners is removably extendable through one of the apertures and into a drum stand so that the bottom panel is horizontally orientated and the top side faces upwardly away from the stand. A bracket is attached to the top end and is configured to releasably secure the plate to a horizontal post securing together a pair of drums.

7 Claims, 4 Drawing Sheets

DRUM SUPPORT ASSEMBLY

BACKGROUND OF THE INVENTION

1. Field of the Invention

The present invention relates to drum support devices and more particularly pertains to a new drum support device for attaching secondary or auxiliary drums to a drum stand that already supports one or more drums.

2. Description of the Prior Art

The use of drum support devices is known in the prior art. U.S. Pat. No. 2,559,739 describes a device for holding a plurality of instruments. Another type of drum support device is U.S. Pat. No. 6,403,869 configured for holding one or more drums in a manner that will make the drums convenient to carry. Still another such device is found in U.S. Pat. No. 5,691,492.

While these devices fulfill their respective, particular objectives and requirements, the need remains for a device that can be used to attach additional drums to drum stand that already supports one or more drums.

SUMMARY OF THE INVENTION

The present invention meets the needs presented above by generally comprising an elongated plate that has a bottom end and a top end. The plate has a first side and a second side. A bottom panel is attached to the bottom end. The bottom panel has a top side and a bottom side. An angle between the top side and the first side is generally between 100 degrees and 160 degrees. The bottom panel has a plurality of apertures extending therethrough. Each of a plurality of fasteners is removably extendable through one of the apertures and into a drum stand so that the bottom panel is horizontally orientated and the top side faces upwardly away from the stand. A bracket is attached to the top end and is configured to releasably secure the plate to a horizontal post securing together a pair of drums.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
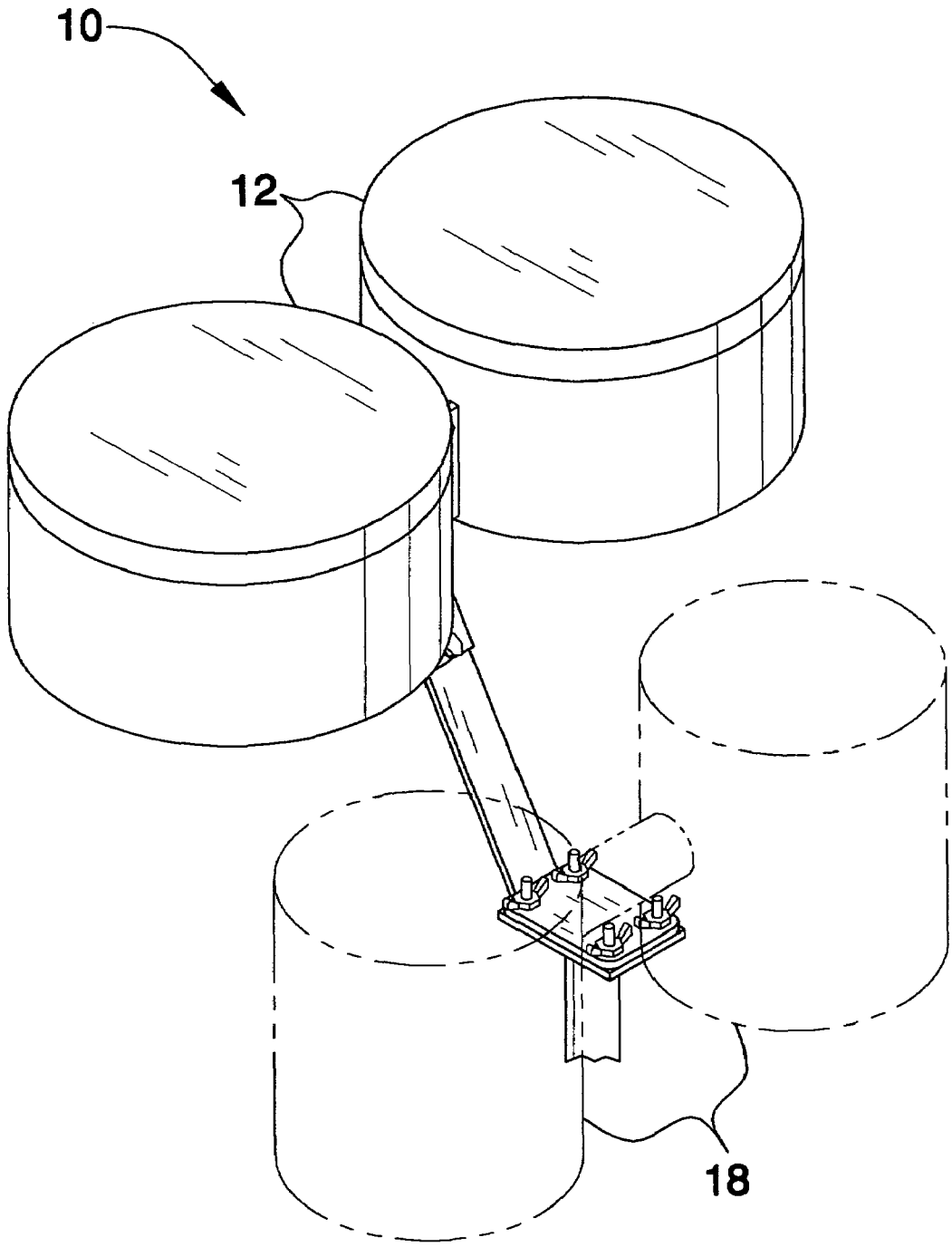
FIG. 1 is a perspective in-use view of a drum support assembly according to the present invention.
Figure 2:
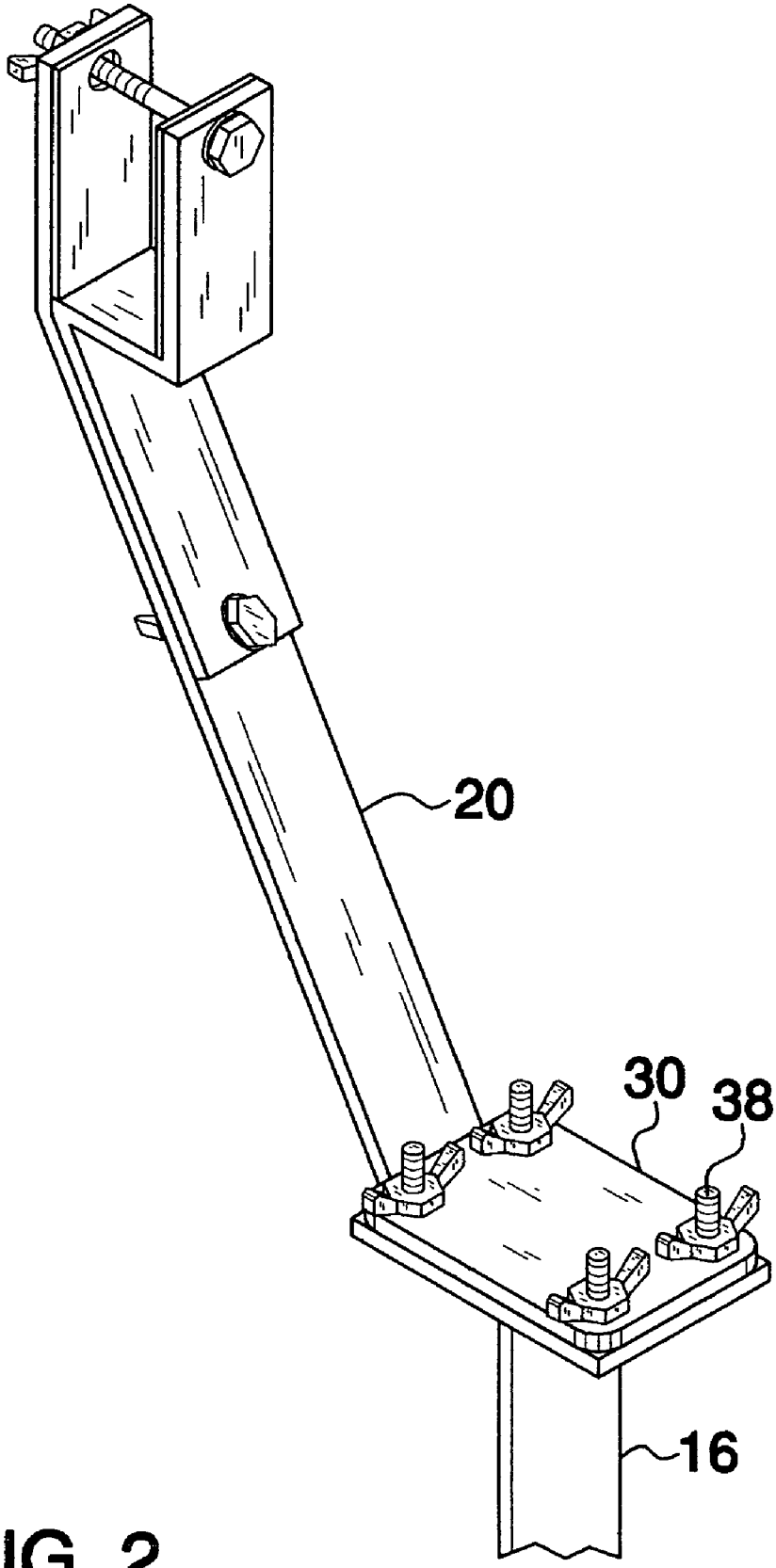
FIG. 2 is a perspective view of the present invention.
Figure 3:
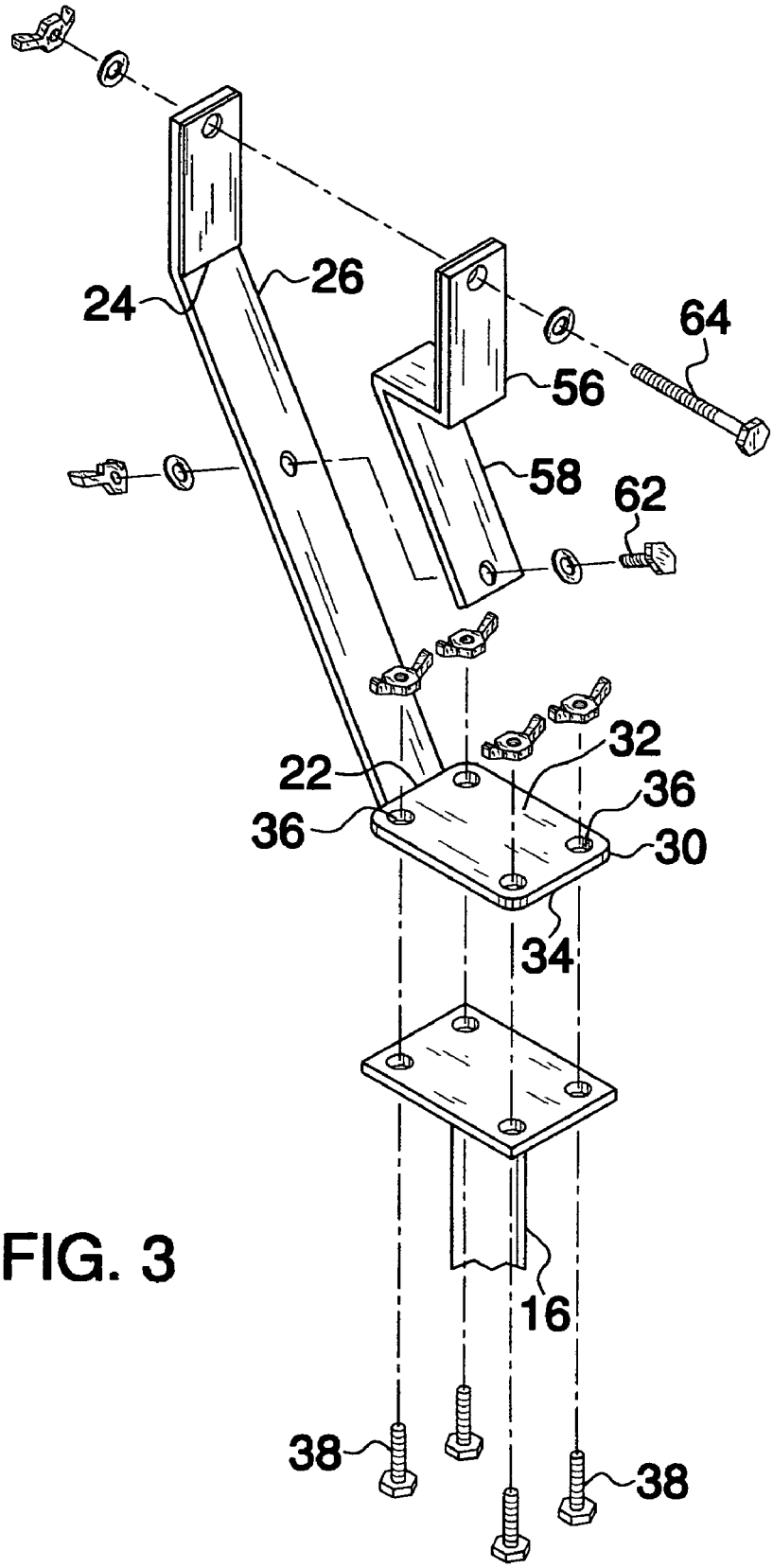
FIG. 3 is an expanded perspective view of the present invention.
Figure 4:
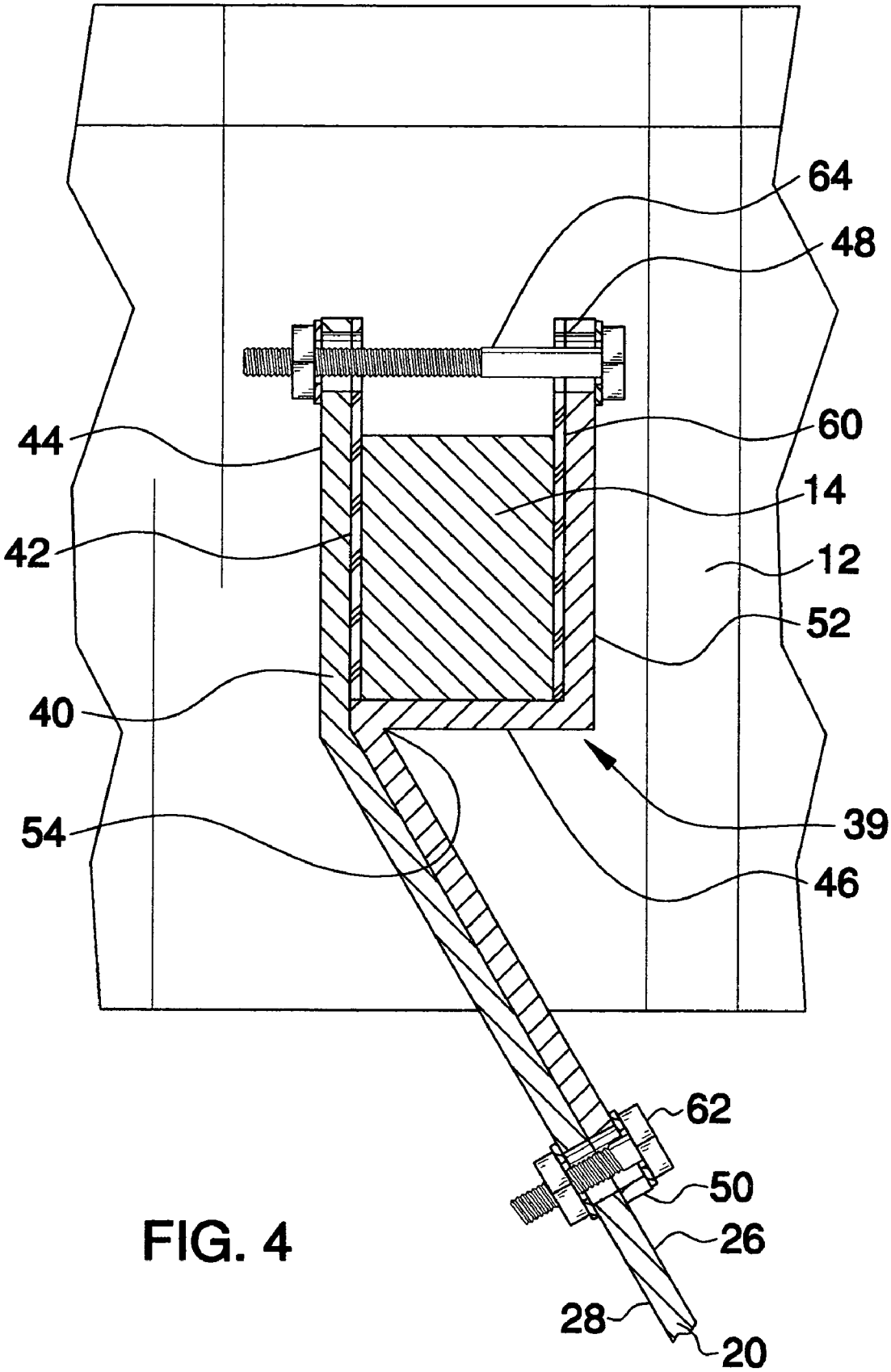
FIG. 4 is a side cross-sectional side view of the present invention.

With reference now to the drawings, and in particular to FIGS. 1 through 4 thereof, a new drum support device embodying the principles and concepts of the present invention and generally designated by the reference numeral 10 will be described.

As best illustrated in FIGS. 1 through 4, the drum support assembly 10 may be attached to a pair of bongo drums 12 and then to a stand 16 that supports a pair of drums 18. The bongo drums 12 are attached together by a horizontal post 14.

The assembly 10 comprises an elongated plate 20 has a bottom end 22 and a top end 24. The plate 20 has a first side 26 and a second side 28. The plate 20 has a length from the bottom end 22 to the top end 24 generally between 12 inches and 24 inches. A bottom panel 30 is attached to the bottom end 22. The bottom panel 30 has a top side 32 and a bottom side 34. An angle between the top side 32 and the first side 26 is generally between 100 degrees and 160 degrees. The bottom panel 30 has a plurality of apertures 36 extending therethrough. Each of a plurality of fasteners 38 is removably extendable through one of the apertures 36 and into the stand 16 so that the bottom panel 30 is horizontally orientated and the top side 32 faces upwardly away from the stand 16.

A bracket 39 is attached to the top end 24 and is configured to releasably secure the plate 20 to the horizontal post 14. The bracket 39 includes an upper panel 40 that is attached to the top end 24 of the plate 20. The upper panel 40 has an inner side 42 and an outer side 44. An angle between the inner side 42 and the first side 26 is generally equal to 270 degrees minus the angle between the top side 32 of the bottom panel 30 and the first side 26.

A coupling arm 46 is removably attached to the upper panel 40. The coupling arm 46 has a first end 48 and a second end 50. The coupling arm 44 has a first bend 52 therein positioned nearer to the first end 48 than the second end 50 and is generally equal to 90 degrees. The coupling arm 46 has a second bend 54 therein positioned nearer to the second end 50 than the first end 48 and is generally equal to the angle between the inner side 44 and the first side 26 minus 90 degrees. An upper portion 56 of the coupling arm 46 is defined between the first bend 52 and the first end 48 and a lower portion 58 is defined between the second bend 54 and the second end 50. The lower portion 58 is abuttable against the plate 20 and the second bend 54 positioned adjacent to the top end 24 of the plate 20 so that the upper portion 56 and the upper panel 40 are spaced from each other and are parallel with respect to each other. The horizontal post 14 is positionable between the upper panel 40 and the upper portion 56. The upper portion 56 has an inner side 60 facing the inner side 42 of the upper panel 40. A plurality of securing members 62 is removably extendable through and secures together the coupling arm 46 and the plate 20. A resiliently compressible coating is positioned on and covers each of the inner sides to ensure a secure fit and to prevent vibration. Additional securing members 64 may be extended between and through the upper portion 56 and the upper panel 40.

In use, the assembly 10 is used as shown above to secure the drums 12 to a stand 16 that already supports a pair of drums 18. This will give a user of the stand 16 four drums to use and allow the user to determine the exact type of drums to be added to the stand 16. The assembly 10 may be removed from the stand 16 when the drums are not being used or when the assembly and stand are being stored.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A drum extension arm assembly for removably attaching a pair of bongo drums to a stand, the bongo drums being attached together by a horizontal post, said assembly comprising:

an elongated plate having a bottom end and a top end, said plate having a first side and a second side;

a bottom panel being attached to said bottom end, said bottom panel having a top side and a bottom side, an angle between said top side and said first side is generally between 100 degrees and 160 degrees, said bottom panel having a plurality of apertures extending therethrough, each of a plurality of fasteners being removably extendable through one of said apertures and into the stand such that said bottom panel is horizontally orientated and said top side faces upwardly away from the stand; and a bracket being attached to said top end and being configured to releasably secure said plate to the horizontal post.

2. The assembly according to claim 1, wherein said plate has a length from said bottom end to said top end generally between 12 inches and 24 inches.

3. The assembly according to claim 1, said bracket including:

an upper panel being attached to said top end of said plate, said upper panel having an inner side and an outer side;

a coupling arm being removably attached to said upper panel, said post being positionable between said coupling arm and said upper panel; and a plurality of securing members being removably extendable through and securing together said coupling arm and said plate.

4. The assembly according to claim 3, wherein an angle between said inner side and said first side being generally equal to 270 degrees minus the angle between said top side of said bottom panel and said first side.

5. The assembly according to claim 4, wherein said coupling arm has a first end and a second end, said coupling arm having a first bend therein positioned nearer to said first end than said second end and being generally equal to 90 degrees, said coupling arm having a second bend therein positioned nearer to said second end than said first end and being generally equal to the angle between said inner side and said first side minus 90 degrees, an upper portion of said coupling arm being defined between said first bend and said first end and a lower portion being defined between said second bend and said second end, said lower portion being abuttable against said plate and said second bend positioned adjacent to said top end of said plate such that said upper portion and said upper panel are spaced from each other and are parallel with respect to each other, said horizontal post being positionable between said upper panel and said upper portion.

6. The assembly according to claim 5, said upper portion having an inner side facing said inner side of said upper panel, a resiliently compressible coating being positioned on and covering each of said inner sides.

7. A drum extension arm assembly for removably attaching a pair of bongo drums to a stand, the bongo drums being attached together by a horizontal post, said assembly comprising:

an elongated plate having a bottom end and a top end, said plate having a first side and a second side, said plate having a length from said bottom end to said top end generally between 12 inches and 24 inches;

a bottom panel being attached to said bottom end, said bottom panel having a top side and a bottom side, an angle between said top side and said first side is generally between 100 degrees and 160 degrees, said bottom panel having a plurality of apertures extending therethrough, each of a plurality of fasteners being removably extendable through one of said apertures and into the stand such that said bottom panel is horizontally orientated and said top side faces upwardly away from the stand;

a bracket being attached to said top end and being configured to releasably secure said plate to the horizontal post, said bracket including;

an upper panel being attached to said top end of said plate, said upper panel having an inner side and an outer side, an angle between said inner side and said first side being generally equal to 270 degrees minus the angle between said top side of said bottom panel and said first side;

a coupling arm being removably attached to said upper panel, said coupling arm having a first end and a second end, said coupling arm having a first bend therein positioned nearer to said first end than said second end and being generally equal to 90 degrees, said coupling arm having a second bend therein positioned nearer to said second end than said first end and being generally equal to the angle between said inner side and said first side minus 90 degrees, an upper portion of said coupling arm being defined between said first bend and said first end and a lower portion being defined between said second bend and said second end, said lower portion being abuttable against said plate and said second bend positioned adjacent to said top end of said plate such that said upper portion and said upper panel are spaced from each other and are parallel with respect to each other, said horizontal post being positionable between said upper panel and said upper portion, said upper portion having an inner side facing said inner side of said upper panel;

a plurality of securing members being removably extendable through and securing together said coupling arm and said plate; and a resiliently compressible coating being positioned on and covering each of said inner sides.

* * * * *